US005996141A

United States Patent [19]

Ibrahim

[11] Patent Number: 5,996,141

[45] Date of Patent: Dec. 7, 1999

[54] SHOWER SPLASH GUARD

[76] Inventor: Bechara Ibrahim, 1484 Beaverpond Drive, Gloucester, Canada, K1B 3R9

[21] Appl. No.: 09/108,202

[22] Filed: Jul. 1, 1998

[30] Foreign Application Priority Data

Jul. 2, 1997 [CA] Canada ..... 2209452

[51] Int. Cl.[6] ..... A47K 3/22

[52] U.S. Cl. ..... 4/609; 4/559

[58] Field of Search ..... 4/558, 559, 609; 211/153

[56] References Cited

U.S. PATENT DOCUMENTS

| | | | |
|---|---|---|---|
| D. 273,609 | 4/1984 | Huffington, Jr. . | |
| D. 297,157 | 8/1988 | Eder . | |
| D. 298,851 | 12/1988 | Bourque . | |
| D. 312,301 | 11/1990 | Brown . | |
| D. 362,054 | 9/1995 | Amnay . | |
| D. 396,273 | 7/1998 | Delawder . | |
| 3,168,365 | 2/1965 | Evans | 211/153 |
| 3,737,921 | 6/1973 | Baumrind . | |
| 4,361,915 | 12/1982 | Siewert . | |
| 4,765,001 | 8/1988 | Smith . | |
| 5,606,752 | 3/1997 | Shenton, Jr. et al. . | |

FOREIGN PATENT DOCUMENTS

| | | |
|---|---|---|
| 56585 | 7/1986 | Canada . |
| 2164909 | 6/1997 | Canada . |

*Primary Examiner*—Charles E. Phillips
*Attorney, Agent, or Firm*—Charles P. Boukus, Jr.

[57] ABSTRACT

Disclosed is a device which, when installed in cooperation with the wall of a shower stall and the front upper edge of a bathtub, prevents water from exiting the gap between a shower curtain and the wall during use of the shower. The device comprises an elongate, generally U-shaped device, one leg of the U-shape or first side wall for sealing engagement with the wall of the stall and the other leg or second wall directed or angled toward the tub. The upper portion of the device on the side wall is cut away to facilitate movement of the shower curtain and rings past the side wall.

9 Claims, 2 Drawing Sheets

SHOWER SPLASH GUARD

FIELD OF THE INVENTION

The invention relates to a device which, when installed in cooperation with the wall of a shower stall and the front upper edge of a bathtub, prevents water from exiting the gap between a shower curtain and the wall during use of the shower.

BACKGROUND OF THE INVENTION

Bathtubs come in various shapes and sizes but the more standard tub is generally of rectangular shape. The internal periphery of the tub curves at the corners into the ends, the tap or faucet end of the tub usually being generally vertical, whereas the other or head end of the tub is usually a slanted surface.

It is a common problem for people who shower in such tubs to find that the shower curtain does not effectively close the gaps at the walls, particularly the wall at the head end of the tub.

Various devices have been designed to overcome this problem.

Sliding doors are well known to better enclose the ends of the stall during showers but many people do not like doors on the tub, particularly when some members of the family prefer bathtub washings to showers. The doors block out some light and give the feeling of a person being more confined or enclosed.

Devices have also been developed which are affixed to the wall and they are capable of holding the curtains closer to the wall at the juncture of the wall and tub ends. Nevertheless, these do not prevent water from dripping outside the tub and have often been found to require some finger dexterity in order to have the curtains held appropriately.

U.S. Design Pat. No. 297,157, Aug. 9, 1988 to Eder relates to a bathtub shower splash guard and illustrates a splash guard which is secured to the wall of the shower stall. There is no clear indication that it extends up to the shower curtain area of the stall.

U.S. Design Pat. No. 298,851 to Bourque relates to a combined shower splash guard and soap holder. The Bourque device provides a support arm for a soap dish or a hand grip as part of the design.

U.S. Pat. No. 4,361,915 to Siewert relates to a shower curtain assembly utilizing a two curtain system.

U.S. Pat. No. 4,765,001 to Smith relates to a splash guide for bathtub showers having an extruded plastic strip and flexible panels in a frame device.

Notwithstanding the above, there is a need for a device for a shower stall which is permanently located in cooperation with the wall and tub and which will prevent water from splashing or dripping outside the curtain adjacent the walls, particularly at the head end of the tub and which preferably includes shelving or other support elements for use.

SUMMARY OF THE INVENTION

The invention relates to a splash deflector device or guard capable of being installed singly or in pairs at opposite ends of a bathtub/shower stall. If only one splash guard is to be installed, the installation at the head end of the tub is preferred as this is where a larger proportion of water may splash out from the gap between a shower curtain and the adjacent wall of the stall.

More particularly, the guard comprises a generally elongate U-shaped device having a flat first side wall, an outer or back wall (or bight portion of the device) and a second side wall, the second side wall having a portion which is at an angle to or curves from the outer wall to a flat, inner edge portion which is generally parallel to the first side wall.

The elongate flat first side wall is secured to the wall of the stall with the outer wall of the guard generally planar with or inwardly slightly of the front wall of the tub. The angled or curved side wall portion angles or curves inwardly to the flat inner edge portion which is adjacent the inner front wall of the tub.

Preferably, one or more shelves and/or a rod are provided within the U-shaped splash guard for holding various items such as bottles of shampoo, razors, soap or face cloth. The shelves preferably have drainage holes therein.

The first side wall is of a width sufficient to enable the guard to be secured to the adjacent wall of the stall by fasteners such as screws or the like. The outer wall is sufficiently wide so as to cover the gap between a curtain edge and the facing stall wall without having to distort the curtain edge in an attempt to reduce the gap.

The side wall with the angled or curving portion extends inwardly to provide deflection of water to the tub, particularly for water deflected by the guard and running down the guard to the upper edge of the tub.

Other advantages and aspects of the invention will become apparent from a consideration of the preferred embodiments described herein in conjunction with the drawings.

DESCRIPTION OF PREFERRED EMBODIMENTS

Figure 1:
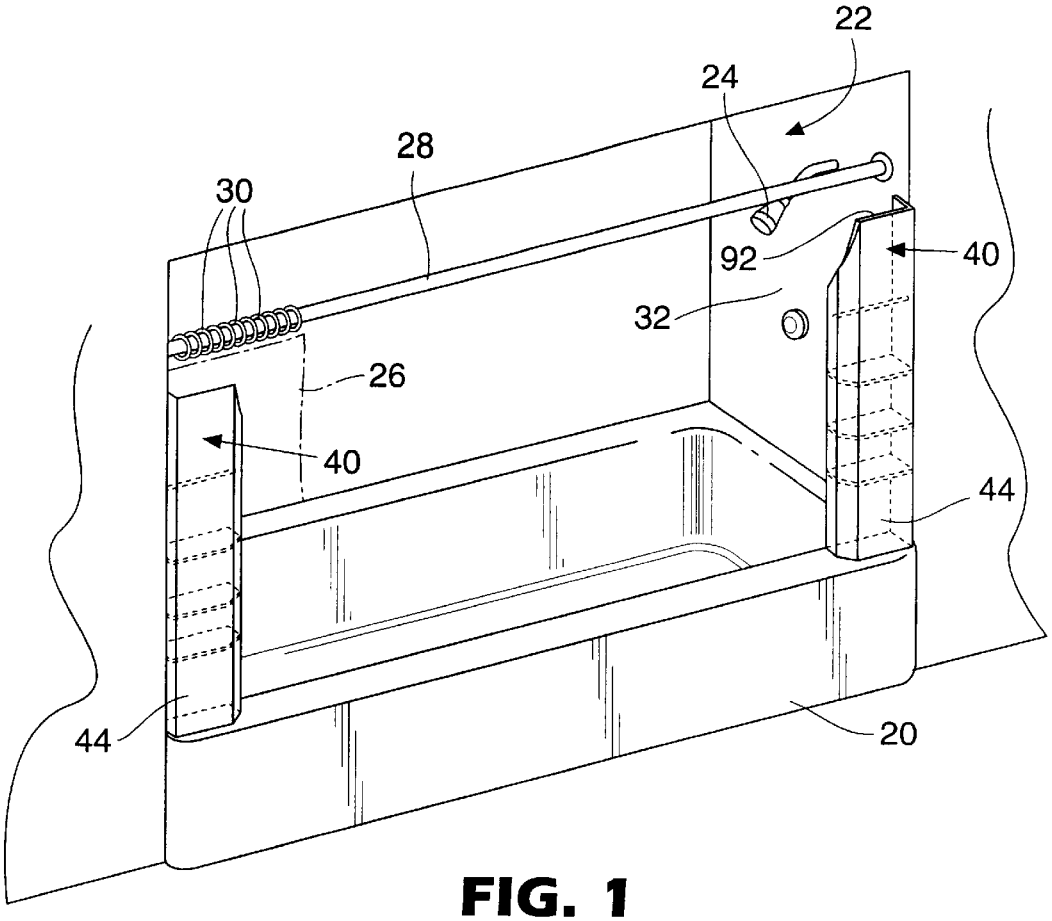
FIG. 1 is a perspective view of a bathtub/shower stall illustrating the inventive splash guard in place, (two (2) being shown).
Figure 2:
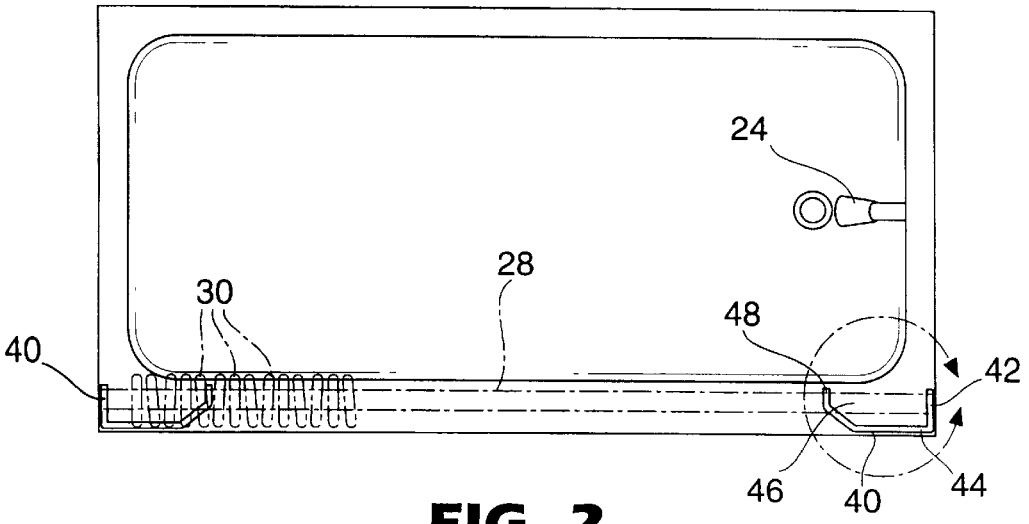
FIG. 2 is a top plan view of part of the stall/tub taken along line 2—2 of FIG. 1.
Figure 3:
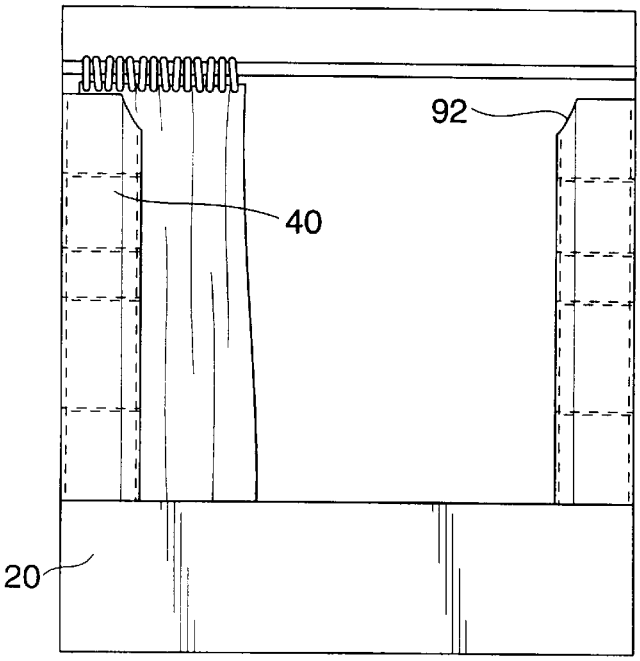
FIG. 3 is an elevational view of the stall/tub as shown in FIG. 1.
Figure 4:
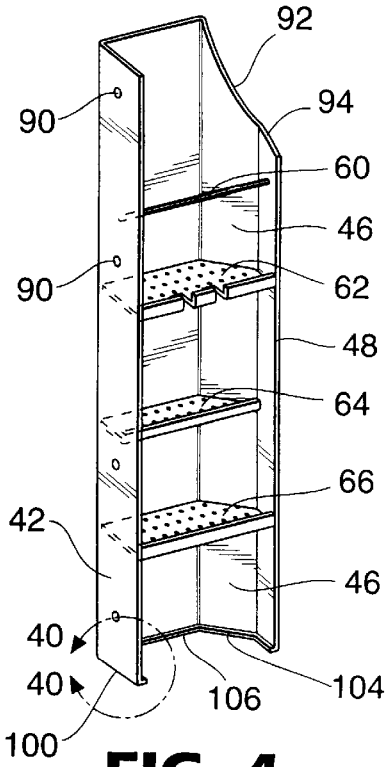
FIG. 4 is a perspective view of the inventive splash guard from the inside.
Figure 5:
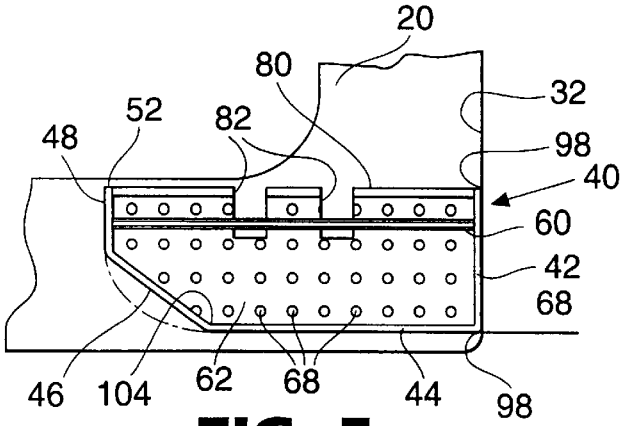
FIG. 5 is an enlarged view of the device in top plan view about line 5—5 of FIG. 2.

Turning to FIGS. 1 and 2 of the drawings, bathtub 20 is located in a recessed portion or shower stall 22 of a bathroom and includes a shower nozzle 24, shower curtain 26, shower curtain rod 28 and hooks 30. Stall 22 has side walls 32. The inventive device, namely splash guard 40, (two being shown), are shown in place and more particularly, guard 40, seen further in FIGS. 3, 4 and 5, is of generally U-shape configuration with long flat (first) side wall 42, an outer or back wall 44 being the bight wall of the U-shaped configuration, angled wall 46 and shorter side wall 48. Angled wall 46 is angled relative to outer wall 44 and the side walls 42 and 48 are parallel to each other and at right angles to back wall 44. Angled side wall portion 46 and side wall portion 48 define a second side wall of the U-shaped configuration of the guard. As shown in FIG. 5 in phantom lines 50, the second wall may include a curved portion or curve completely to the inner edge 52 of side 48.

Guard 40 is made of any suitable plastic material, such as a hard polyurethane and polycarbonate and may be transparent or coloured.

Figure 6A:
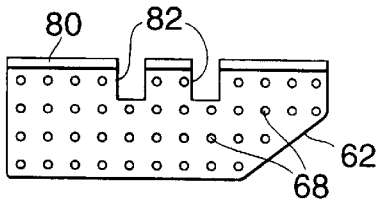
FIGS. 6*a, b* and *c* are top plan views of shelving for the guard.
Figure 6B:
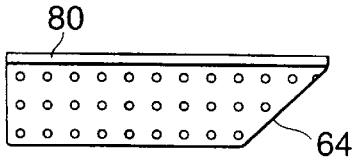
Figure 6C:
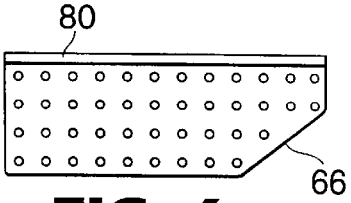

As shown in FIGS. 4 and 5, the generally U-shaped configuration permits a rod 60 and shelving 62, 64 and 66 to be incorporated into the guard. Although these items may be optional, they are part of the preferred embodiment. Any combination of shelving or means for holding items such as rod 60 and shelving 62, 64 and 66 are contemplated. Holes or apertures 68 in shelves 62, 64 and 66 permit drainage. Preferred embodiments of shelving 62, 64 and 66 are shown in FIGS. 6*a*, 6*b* and 6*c*. Preferably the shelves have a front lip 80 and shelf 62 has slots 82 for straight razors and can support shaving cream containers or the like. Shelf 64 is smaller in depth and can hold soap and shelf 66 can hold hair shampoo bottles or the like.

One of the problems with curtained shower stalls is pulling a curtain 34 far enough to prevent water from splashing out between the gap caused by the curtain not closely adhering to the wall of the stall. In the present case, the guard 40 extends along the face of the stall and tub sufficiently that the curtain edge 90 extends past the angled wall 46 of the guard 30, as more particularly shown in FIGS. 3 and 4.

In order to facilitate this, in view of the placement of the guard 40 relative to the curtain rod 28, which in most cases is already in place when the guard 40 is installed, the top or upper portion 92 and 94 of the angled wall 46 and short side wall 48 respectively of the guard 40 are bevelled downward so that the curtain hooks 30 can pass freely over the tops 92 and 94.

Figure 4A:
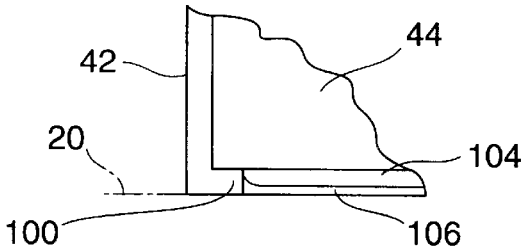
FIG. 4*a* is an enlarged view of the bottom of the splash guard taken about line 4*a*–4*a* of FIG. 4.

In securing guard 40 in place, pre-drilled holes 90 can be provided in side wall 42. Guard 40 is held in place and the holes marked on the side 32 of the stall 22. Appropriate holes may then be drilled into the tile of the stall using the appropriate drill. The guard 40 is then fastened by threaded fastener to the stall wall 32 and caulking 98 is applied to the junction of walls 32 and 42. Further, preferably, the bottom edge 100 of the guard 40 includes lip 104 shown enlarged in FIG. 4*a*. The purpose of lip 104 is to provide structural rigidity to the guard, lip 104 extending around the inside bottom of the guard from side to side. Preferably bottom 100 has pressure adhesive two way tape, (not shown), applied thereto which will help hold guard 40 in place while securing it to the side walls. Once the guard is installed, a bead of caulking 106 is placed around at least the inside of the guard at the juncture with the tub and lip 104. (FIG. 4*a*). Lip 104 may be integrally made with the sides or a piece separately made and glued to respective sides.

Once installed, water which would normally be deflected outwardly from the gap between the edge of the curtain and wall of the stall is prevented from moving outwardly onto the floor by guard 40 which re-directs the water back into the tub. Not only is this deflection of water provided at the upper edge of the tub, but it is provided for substantially the entire height of the stall.

Although guard 40 is particularly useful at the head end of the tub because of the difficulty of pulling the curtain tight to the wall due to the slant of the head end of the tub, the guard 40 can also be adapted for use at the foot or tap end of the tub, the device at that end being effectively a mirror image of the device at the head end. Only one guard 40 needs to have shelves or other holding means but obviously both could include various assortments of means to hold articles of use to users of the shower stall.

In a preferred form of the guard 40, side wall 42 is about 8.25 cm (3¼ inches), outer or back wall 44 is about 16.5 cm (6½ inches), angled wall 46 is about 5.7 cm (2¼ inches) and short side wall 48 is about 3.18 cm (1¼ inches), the total width being about 22.23 cm (8¾ inches) and the overall length is about 144.8 cm (57 inches). With the length of the short side having the bevelled top 94 about 127 cm (50 inches).

Shelf 66 is about 30.5 cm (12 inches) from the bottom and the spacing between shelves 66 and 64 is about 30.5 cm (12 inches), between shelves 64 and 62 is about 20.3 cm (8 inches) and between shelf 62 and rod 60 about 35.6 cm (14 inches). The lip 104 is about 0.3175 cm (⅛ inch) high and 0.625 cm (¼ inch) wide.

As noted previously, it will be appreciated that walls 46 or walls 46, 48 could have a curved formation, (like phantom line 50), curving from the outer wall 44 to the inner edge 52. Accordingly, reference of the side wall 46 being "angled" relative to outer wall 44 or extending obtusely from said outer wall is to be interpreted as including a curved wall portion.

Although preferred embodiments of the invention have been set forth herein, applicant claims all modifications to the defector which fall within the appended claims.

The embodiments of the invention in which an exclusive property or privilege is claimed are defined as follows:

1. A splash guard for use with a bathtub or shower stall comprising:

elongate first and second side walls and intermediate outer wall defining a generally U-shaped structure, each of said first and second side walls having inner edges, and said first and second side walls and said outer wall each having top and bottom edges defining a height therebetween;

said first side wall and said outer wall being substantially at right angles to each other and said second side wall having at least a first portion extending from said outer wall which is at an obtuse angle to said outer wall; and the bottom edges of each of said first and second side walls and outer wall being planar and at least a portion of said second side wall having a height less than the height of the outer wall, whereby the top edge of said portion of said second side wall is lower than said outer wall thereby facilitating ease of movement of a shower curtain and rinds past said second side wall.

2. The splash guard of claim 1 wherein said second side wall has a second portion extending from the first portion generally parallel to said first side wall.

3. The splash guard of claim 1 wherein said second side wall has a second portion extending from the first portion which is generally parallel to said first side wall and the top edge of said first and said second portions of said second side wall slant downwardly from said outer wall.

4. The splash guard of claim 1 wherein the height of said first side wall and said outer wall are the same.

5. The splash guard of claim 4, wherein the bottom edges of each of the first and second side walls and said outer wall are planar and at least two of said bottom edges having a reinforcing shoulder connected therewith.

6. The splash guard of claim 1 further comprising a rod extending between said first and second side walls and spaced forwardly from said outer wall.

7. The splash guard of claim 1 further including at least one shelf between said side walls and extending forwardly of said outer wall.

8. The splash guard of claim 7 wherein there are three shelves vertically spaced from each other.

9. The splash guard of claim 8 further including a rod extending between such side walls and spaced forwardly from said outer wall.

* * * * *